US005240120A

United States Patent [19]

McDonough

[11] Patent Number: 5,240,120

[45] Date of Patent: Aug. 31, 1993

[54] APPARATUS FOR HOLDING EARRINGS

[76] Inventor: Cookie McDonough, 5840 Price Rd., Milford, Ohio 45150

[21] Appl. No.: 909,182

[22] Filed: Jul. 6, 1992

[51] Int. Cl.[5] ..... A47F 7/00

[52] U.S. Cl. ..... 211/13; 211/113; 206/495; D6/469

[58] Field of Search ..... 211/13, 113; 206/495, 206/6.1; D6/310, 469

[56] References Cited

U.S. PATENT DOCUMENTS

| | | | |
|---|---|---|---|
| D. 315,460 | 3/1991 | Sorce | D6/469 |
| 3,718,260 | 2/1973 | Sharp | 211/13 |
| 3,901,165 | 8/1975 | Schlesinger | 211/113 X |
| 4,244,301 | 1/1981 | Nakatsu | 211/113 X |
| 4,401,219 | 8/1983 | Mink . | |
| 4,606,458 | 8/1986 | LaBate . | |
| 4,720,012 | 1/1988 | Dufour | 206/495 X |
| 4,739,886 | 4/1988 | Seaberg | D6/469 X |
| 4,760,920 | 8/1988 | Thomsen . | |
| 4,821,883 | 4/1989 | Miller . | |
| 4,848,585 | 7/1989 | Snyder . | |
| 4,848,586 | 7/1989 | Jasik . | |
| 4,923,069 | 5/1990 | Germain et al. | 206/495 X |
| 4,958,727 | 9/1990 | Bergeron . | |
| 4,966,287 | 10/1990 | Snyder | 211/113 X |
| 5,025,918 | 6/1991 | Bergeron | 206/495 X |
| 5,033,625 | 7/1991 | Campbell | 206/495 X |
| 5,050,745 | 9/1991 | Sanders | 211/113 X |

*Primary Examiner*—Robert W. Gibson, Jr.
*Attorney, Agent, or Firm*—Barbara Joan Haushalter

[57] ABSTRACT

An apparatus for holding earrings operates as a display case and a storage case. The apparatus includes one or more flexible sheets, each sheet having a plurality of typically symmetrically spaced apertures thereon. The apertures are for receiving the post of each earring, wherein the ornamental design of the earring is visible on the front side of the flexible sheet. The retainer is inserted onto the post on the rear side of the flexible sheet to hold the earrings to the flexible sheet.

10 Claims, 5 Drawing Sheets

APPARATUS FOR HOLDING EARRINGS

BACKGROUND OF THE INVENTION

The present invention relates to a jewelry holding apparatus and, more particularly, to a flat flexible sheet apparatus for holding pierced earrings.

Throughout the years of recorded history, men and women have been eager to possess and use ornamental jewelry about their clothing and person. Earrings in particular have been used by both sexes, and still are for reasons that are both varied and ornamental. As a result of the attractiveness of the use of earrings, many people, particularly women, have acquired fairly large collections of earrings for the pleasure of variety.

Earrings for pierced ears are, perhaps, the more popular form of earrings worn currently, typically by women. Such earrings include an exposed ornamental design which may include a precious stone or metal, and a back having a post or thin elongated shaft extending therefrom. The post is inserted through a previously pierced hole in the ear lobe and, thereafter, held in position in the ear by a retainer which is slid onto the post behind the ear lobe. Most individuals who wear jewelry of this type gradually acquire a collection of different styles and designs of pierced earrings, and then require a container in which to keep the collection while at home and to transport the jewelry while traveling or on vacation.

Most conventional jewelry containers available simply provide a cavity, box, or drawer into which the jewelry may be placed. Unfortunately, finding a matching pair of earrings with the associated retainers is very difficult when the jewelry is all stored together, particularly in a single cavity. Additionally, viewing the collection of earrings to find a pair which best accessorize the current outfit of the user is also very difficult when the jewelry is all stored and jumbled together. It would be desirable, then, to have a jewelry storage apparatus which could store earrings as individual pairs, and display the collection.

One attempt to overcome these problems is to compartmentalize the jewelry container. However, the compartments tend to be quite large, in order to be versatile enough to hold various sized pieces of jewelry in a compartment, such as a decorative pin, bracelet, necklace, ring, or pair of earrings. Consequently, numerous items of jewelry, especially smaller items such as earrings, are stored in a single compartment. The jewelry items in each compartment then strike each other, and can scratch or bend. It would be desirable, then, to have a jewelry storage and display apparatus which avoids striking and scratching of the jewelry.

In general, the desiderata have not been achieved in any of the jewelry storage means of the prior art. It is seen then that there exists a need for an apparatus which will be particularly suitable for holding earrings both for display and storage which will avoid scratching of the jewelry and separation of one of a pair of earrings from the other of the pair during storage, and will enable the user to view substantially all of the contents of the container.

SUMMARY OF THE INVENTION

This need is met by the jewelry storage apparatus according to the present invention, wherein the apparatus is particularly suitable for holding earrings both for display and storage. It is an advantage of the present invention scratching of the jewelry and separation of one of a pair of earrings from the other of a pair is prevented. Display of each pair of earrings during storage enables the user to view substantially all of the contents of the container.

In accordance with one aspect of the present invention, an apparatus for holding pierced earrings comprises at least one flexible sheet having a front side and a rear side. A plurality of apertures is situated on each flexible sheet for receiving the post of each earring, wherein the ornamental design is visible on the front side of the flexible sheet and the retainer is inserted onto the post on the rear side of the flexible sheet to hold the earrings to the flexible sheet.

In an alternative embodiment of the present invention, an apparatus for holding clip earrings also comprises at least one flexible sheet having a front side and a rear side. A plurality of apertures are situated on each flexible sheet for receiving the clip portion of each earring, wherein each ornamental design is visible on the front side of the flexible sheet and each clip portion is inserted through a separate one of the plurality of apertures to hold the earrings to the flexible sheet.

Accordingly, it is an object of the present invention to provide a jewelry display and storage apparatus for use with pierced or clip-on earrings. Other objects and advantages of the invention will be apparent from the following description, the accompanying drawings and the appended claims.

DETAILED DESCRIPTION OF THE PREFERRED EMBODIMENTS

Figure 1A:
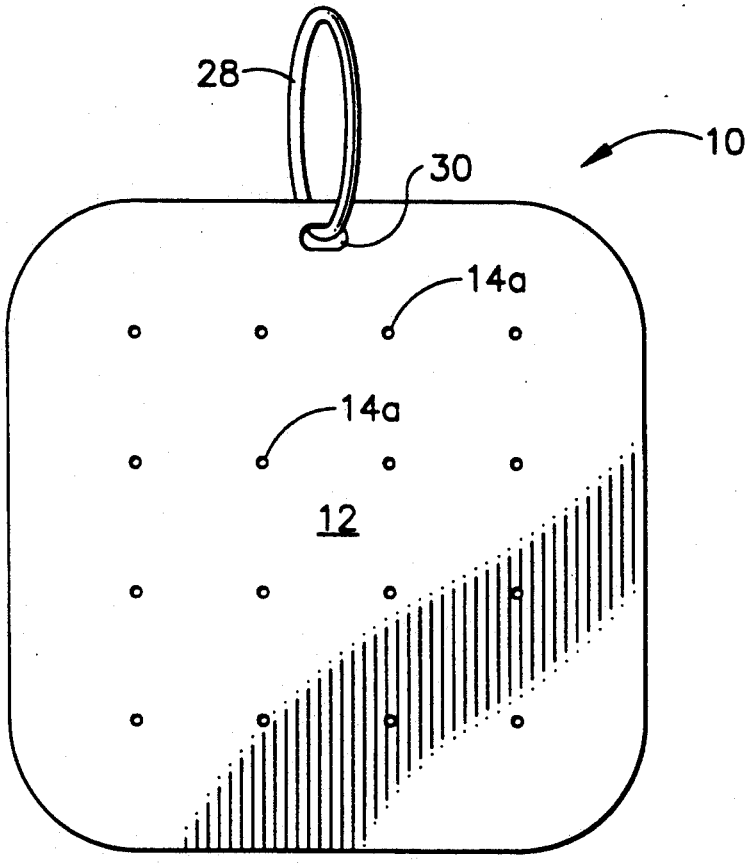
FIGS. 1A and 1B are front views of an apparatus comprised of one flexible sheet for displaying and storing pierced and clip earrings, respectively.
Figure 1B:
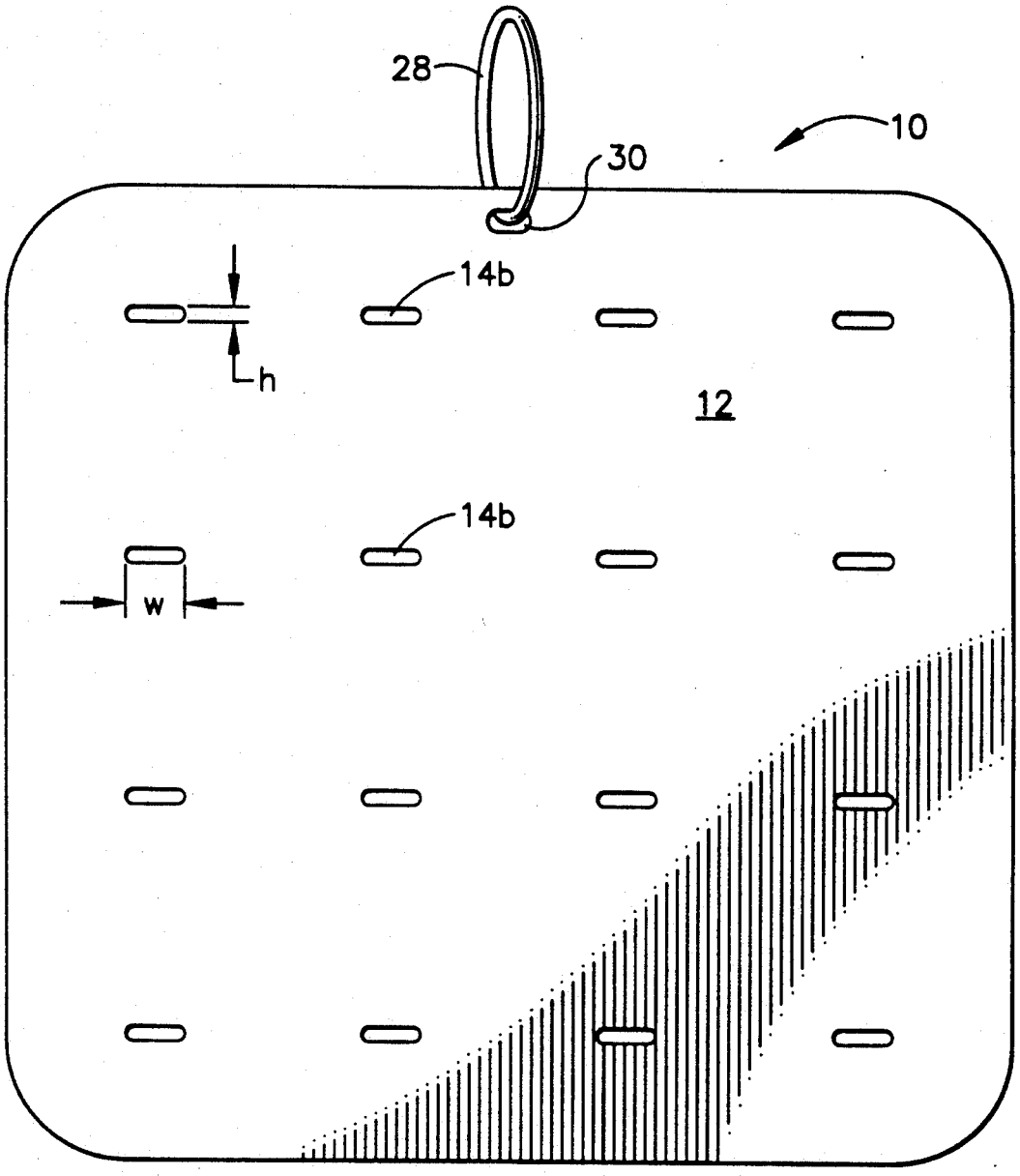

Referring to the drawings, in FIGS. 1A and 1B there is illustrated a jewelry holding and storage apparatus 10 according to the present invention. The apparatus illustrated in FIG. 1A, which is particularly adaptable for storing and displaying pierced earrings, includes at least one flexible sheet 12 having a plurality of preferably evenly spaced apertures **14*a* situated thereon. The sheet 12 may be any suitable size or design, typically measuring approximately 6" by 8" and having rounded edges. Although the sheets 12 are shown in the figures as being rectangular in shape, this is for purposes of illustration only and is not to be considered as limiting the invention. In a preferred embodiment illustrated in FIG. 1A, the apertures 14*a* are typically 1/12th inch in diameter, and adjacent apertures 14*a*** are spaced approximately 1 inch apart.

Figure 2:
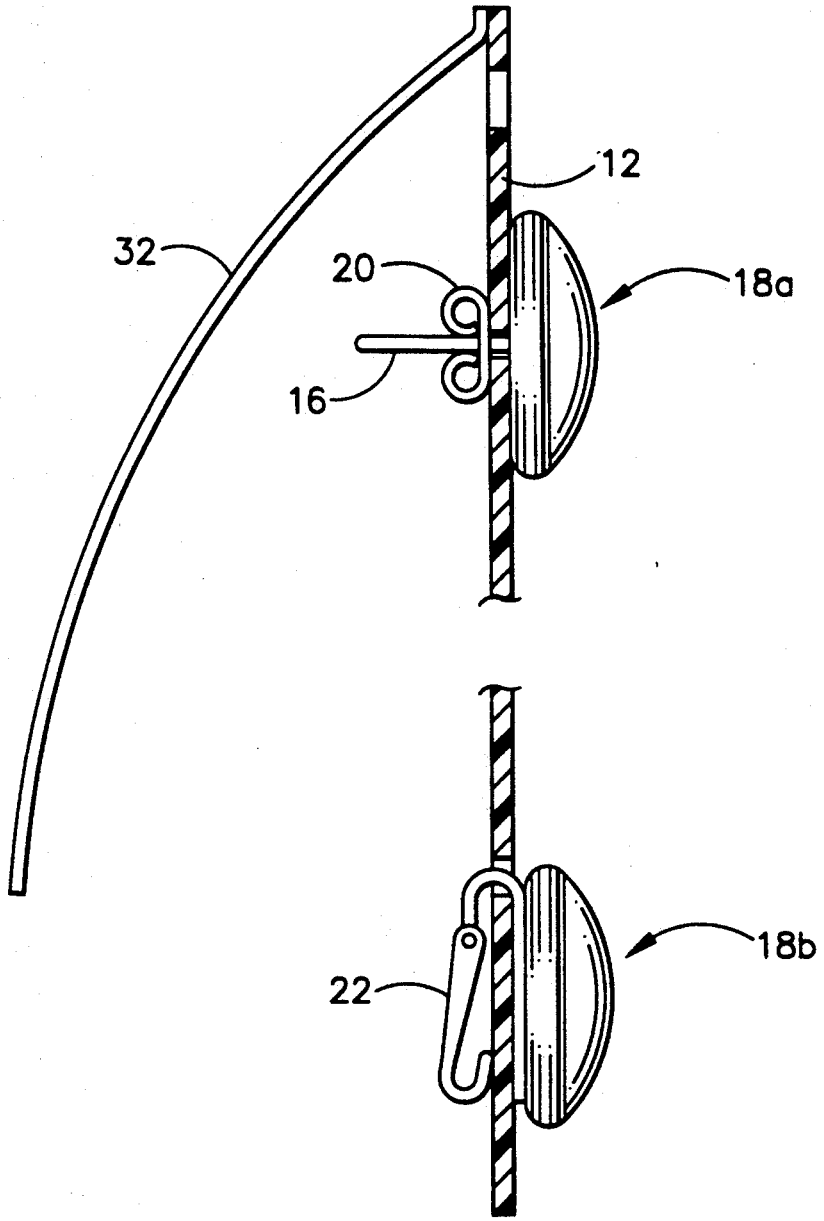
FIG. 2 is a side view of the embodiments of FIGS. 1A and 1B to illustrate attachment of a pierced earring and a post earring, respectively, to the flexible sheet.

Referring now to FIG. 2 and continuing with FIG. 1A, the embodiment illustrated in FIG. 1A is particularly suitable for displaying and storing pierced earrings, as mentioned above. In this embodiment, the apertures **14*a* receive a post 16 of each earring 18*a*, wherein the ornamental design on the front of the earring 18*a* is visible on the front side of the flexible sheet 12. A retainer 20 of each earring 18*a* is inserted onto the post 16 on the rear side of the flexible sheet to hold the earrings 18***a* to the flexible sheet 12.

If the earrings to be displayed and stored are of the clip style, rather than the pierced style, an alternative embodiment of the flexible sheet 12 preferably has a plurality of evenly spaced slot apertures 14*b* situated thereon, as illustrated in FIG. 1B. In a preferred embodiment of the apparatus 10 illustrated in FIG. 1B, the slot apertures 14*b* are typically have a width w of ½" and a height h of ⅛", and adjacent apertures 14*b* are spaced approximately 2 inches apart.

The embodiment illustrated in FIG. 1B is particularly suitable for displaying and storing clip earrings. The apertures 14*b* receive a clip portion 22 of each earring 18*b*, wherein the ornamental design on the front of the earring 18*b* is visible on the front side of the flexible sheet 12. Each clip portion 22 is inserted through a separate one of the plurality of slot apertures 14*b* and flipped closed to hold the earrings 18*b* to the flexible sheet 12.

Figure 3A:
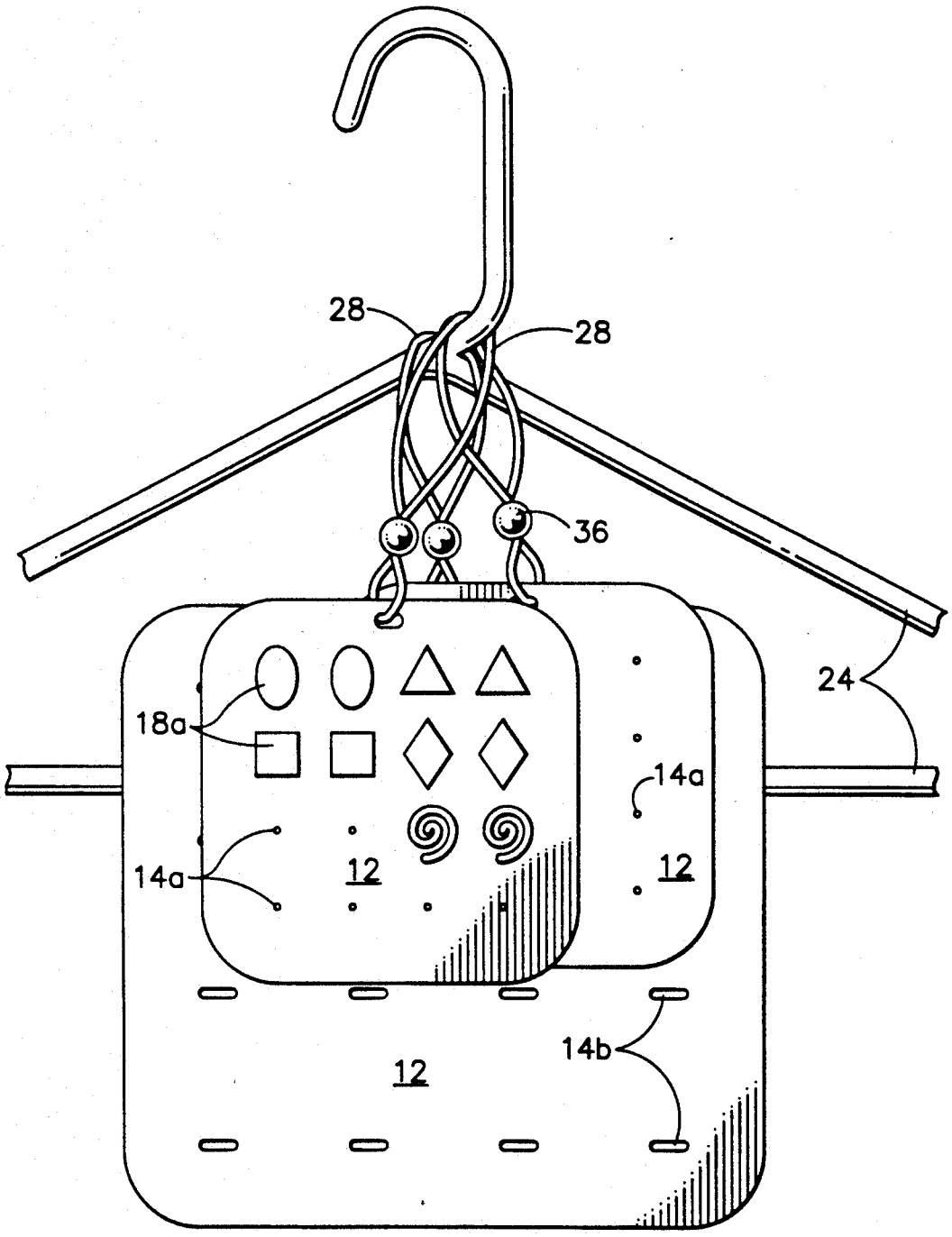
FIGS. 3A and 3B illustrate multiple of the flexible sheets of FIGS. 1A and 1B, which are retained together on a hanger and in a storage case, respectively.
Figure 3B:
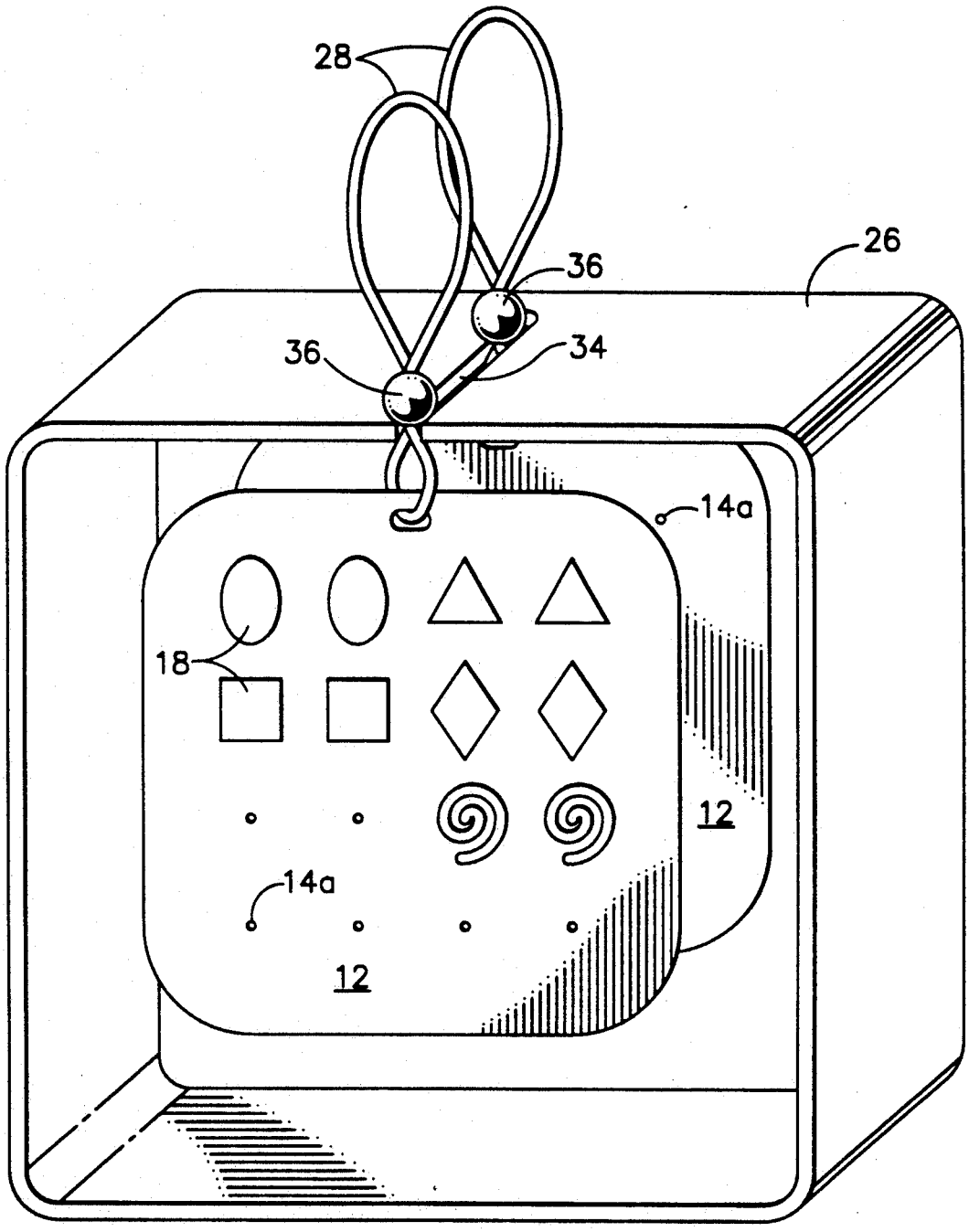

Referring now to FIGS. 3A and 3B, multiple of the flexible sheets 12 of FIGS. 1A and 1B can be retained together, when one sheet 12 is insufficient to hold all of the user's pairs of earrings. Multiple flexible sheets 12 can be retained together by any suitable means including, for example, on a hanger 24 as shown in FIG. 3A, or in a housing such as storage case 26 shown in FIG. 3B. To facilitate display and storage of one or more flexible sheets 12, a hanging means may be attached to a top portion of each sheet 12. The hanging means is comprised of an optional holding means 28, such as a decorative fabric cord or metal chain, insertable in a large aperture or slot 30 to hold the one or more sheets 12 on the hanger 24 or in the storage case 26. The holding means 28 may form any suitable size loop, depending on the item which the sheets 12 are to be hung from.

The flexible sheets may be decorated with color, if desired. Additionally, an optional fabric flap 32 shown in FIG. 2, measuring the same size as the sheet 12, may be placed over the front or, preferably, the back of each flexible sheet 12 and attached thereto by any suitable means. Placing the fabric flap 32 over the back of the sheet 12 protects the earring backs 16 or 22 on one sheet from scratching the ornamental design on the front of each earring 18*a* or 18*b* on adjacent multiple sheets 12.

Continuing with FIG. 3B, the storage case 26 is preferably of a clear plastic material and may be machined or manufactured using any suitable means to provide a top aperture 34 through which the holding means 28 can be inserted. The holding means 28, exterior to the storage case 26, can then be used to hang or carry the storage case 26. The hanging means comprised of the slot 30 and the holding means 28 may also include a bead 36 or other catch means. The bead 36 may be attached to the holding means 28 to maintain the loop at the desired size, and to facilitate keeping the holding means 28 exterior to the aperture 34 of the case 26.

The present invention is suitable for storing and displaying pierced or clip earrings in an organized manner which allows the user to view at a glance the selection of earrings. The apparatus of the present invention is advantageous in that it protects the earrings from scratching and chipping which can occur when several pairs are jumbled together in a conventional jewelry case. The optional holding means can be decorative as well as functional, to allow one or multiple sheets to be hung from a hanger or in a storage case.

Having described the invention in detail and by reference to the preferred embodiment thereof, it will be apparent that other modifications and variations are possible without departing from the scope of the invention defined in the appended claims.

What is claimed is:

1. An apparatus for displaying and storing earrings, the earrings including an ornamental design and a back, the back having a post extending therefrom and insertable into a retainer, the apparatus comprising:

at least one flexible sheet having a front side and a rear side;

a plurality of apertures on the at least tone flexible sheet for receiving the post of each earring, wherein the ornamental design is visible on the front side of the at least one flexible sheet and the retainer is inserted onto the post on the rear side of he at least one flexible sheet to hold the earrings to the at least one flexible sheet; and a hanging means attached to a top portion of the at least one flexible sheet, the hanging means including a large aperture in a center top portion of the at least one flexible sheet, a holding means forming a loop through the large aperture, and a catch means to maintain the loop size.

2. An apparatus as claimed in claim 1 wherein the plurality of aperture extend across the width and down the length of the at least one flexible sheet such that each of the plurality of apertures is approximately one inch from each adjacent of the plurality of apertures.

3. An apparatus as claimed in claim 1 wherein each of the plurality of apertures is approximately 1/12th inch in diameter.

4. An apparatus as claimed in claim 1 wherein the at least one flexible sheet comprises a plurality of flexible sheets.

5. An apparatus as claimed in claim 1 further comprising a housing for holding the at least one flexible sheet containing earrings.

6. An apparatus for displaying and storing earrings, the earrings including an ornamental design and a clip portion, the apparatus comprising:

at least one flexible sheet having a front side and a rear side;

a plurality of apertures on the at least one flexible sheet for receiving the clip portion of each earring, wherein each ornamental design is visible on the front side of the at least one flexible sheet and each clip portion is inserted through a separate one of the plurality of apertures to hold the earrings to the at least one flexible sheet; and a hanging means attached to a top portion of the at least one flexible sheet; the hanging means including a large aperture in a center top portion of the at least one flexible sheet, a holding means forming a loop through the large aperture, and a catch means to maintain the loop size.

7. An apparatus as claimed in claim 6 wherein the plurality of apertures extending across the width and down the length of the at least one flexible sheet such that each of the plurality of apertures is approximately two inches from each adjacent of the plurality of apertures.

8. An apparatus as claimed in claim 6 wherein each of the plurality of apertures comprises a slot having a width of approximately ½ inch and a height of approximately ⅛ inch.

9. An apparatus as claimed in claim 6 wherein the at least one flexible sheet comprises a plurality of flexible sheets.

10. An apparatus as claimed in claim 6 further comprising a housing for holding the at least one flexible sheet containing earrings.

* * * * *